United States Patent [19]

Snee

[11] Patent Number: 4,491,168

[45] Date of Patent: Jan. 1, 1985

[54] WEAR RESISTANT INSERT FOR CAST LIGHTWEIGHTED PISTONS AND METHOD OF CASTING

[75] Inventor: David J. Snee, Chardon, Ohio

[73] Assignee: Imperial Clevite Inc., Glenview, Ill.

[21] Appl. No.: 498,537

[22] Filed: May 26, 1983

Related U.S. Application Data

[63] Continuation of Ser. No. 224,838, Jan. 13, 1981, abandoned.

[51] Int. Cl.[3] ..... B22D 19/08

[52] U.S. Cl. ..... 164/98; 164/112; 164/120

[58] Field of Search ..... 164/98–103, 164/120, 112, 319, 75

[56] References Cited

U.S. PATENT DOCUMENTS 3,533,329 10/1970 Galli ..... 92/222

4,120,081 10/1978 Rösh et al. ..... 29/156.5 R

*Primary Examiner*—Kuang Y. Lin

*Attorney, Agent, or Firm*—Russell E. Baumann

[57] ABSTRACT

The wear resistant insert is an annular ring of austenitic iron alloy. It has a peripheral surface which conforms to the exterior of the piston into which it is to be cast. A plurality of frangible tabs project outward from the periphery. When casting a piston, the insert is supported on a ledge in a die cavity. A predetermined amount of aluminum alloy is poured into the die cavity and the cavity is closed by a punch. The punch applies a force on the solidifying alloy. As the aluminum alloy shrinks during solidification, the pressure severs the frangible tabs allowing the insert to shift.

3 Claims, 8 Drawing Figures

WEAR RESISTANT INSERT FOR CAST LIGHTWEIGHTED PISTONS AND METHOD OF CASTING

This is a continuation of application Ser. No. 224,838, filed Jan. 13, 1981, now abandoned.

BACKGROUND OF THE INVENTION

This invention relates to the art of casting composite articles. It is particularly applicable to casting improved lightweight pistons and will be described with particular reference thereto. It will be appreciated, however, that the invention also finds application in casting other composite articles, particularly those which include wear resistant inserts.

Aluminum alloys and other lightweight materials are advantageously used in the manufacture of pistons. One method of casting aluminum and other alloys is known as squeeze casting. In squeeze casting, a female die cavity is fashioned in the shape to be cast. The die is open at the top to allow a molten alloy to be poured into the die cavity. The die is closed by a top punch which is inserted into the upper opening of the die cavity. The punch exerts a pressure on the molten metal which cntinuously forces the alloy against the walls of the die cavity as it solidifies. The top punch enters the die cavity further with shrinkage. An article cast by the squeeze casting technique has good conformity to the die cavity surface, has a fine microstructure, and relatively little or no porosity.

Aluminum and many other lightweight alloys tend to wear quickly. This lack of wear resistance makes aluminum and other lightweight alloy pistons undesirable for heavy-duty engines such as are found in large trucks, large farm vehicles, and off the highway equipment. To improve the wear resistance of aluminum and other lightweight pistons, it has been suggested that a ring of wear resisted material be inserted around the piston. Examples of such composite piston structures are illustrated in U.S. Pat. No. 4,008,051, issued Feb. 15, 1977 to T. M. Cadle, U.S. Pat. No. 3,533,329, issued Oct. 13, 1970 to E. Galli, U.S. Pat. No. 2,956,846, issued Oct. 18, 1960 to W. E. McCullough, and U.S. Pat. No. 2,550,879, issued May 1, 1951 to C. E. Stevens, Jr.

These composite pistons are cast in a permanent mold which has runners, gates, or risers for introducing molten metal into the mold cavity at the proper places and rates. To allow for shrinkage, as much as 40% extra alloy is poured into the mold, runners, gates, and risers. When the metal solidifies, the two or more parts of the permanent mold are opened and the piston is removed. Various machining steps are needed to cut off the excess metal, adjust the piston dimensions for shrinkage, and prepare it for precise finish machining. The piston tends to be weakened by porosity and a coarse microstructure, both of which are attributable to shrinkage from the die walls during solidification.

The wear resistant insert ring, commonly an iron alloy, and the aluminum piston body have different physical properties. For example, the iron alloy's specific gravity is generally 2 to 3 times that of the aluminum alloy, the iron alloy's thermal expansion coefficient is generally 1 to 1½ times that of the aluminum alloy, the iron alloy's thermal conductivity is generally less than half that of the aluminum alloy. These different physical properties cause residual stresses in the composite pistons.

To resist these stresses, it is essential that a strong bond be formed between the wear resistant ring and the aluminum alloy. In its normal life cycle, a composite piston is subject to the shocks and vibrations of innumerable firing cycles as well as numerous heating and cooling cycles from starting and stopping the engine. Even a minute crack or bonding failure between the wear resistant ring and the aluminum alloy can propagate quickly under these adverse conditions. The propagation of cracks is accelerated by the formation of a brittle aluminum-iron alloy or the formation of oxides at the interface. The propagation of cracks can cause pieces of pistons to break loose resulting in catastrophic engine damage.

Although composite articles have been squeeze cast or molded in the past, note U.S. Pat. No. 3,792,726, issued Feb. 19, 1974 to Sakai et al., U.S. Pat. No. 2,157,453, issued May 9, 1939 to Jaegar, U.S. Pat. No. 1,950,356, issued Mar. 6, 1934 to DeBats, and Japanese Patent 9557, issued July 4, 1961 to Iwamura et al. (Chemical Abstracts 14862(h), 1962), squeeze casting of pistons has not, heretofore, been successful. This may be attributable to the difficulty in achieving adequate bonding, particularly to the lower side of the wear resistant ring. This may also be attributable to the additional internal stresses from flexing of the wear resistant ring under the forces from the top punch.

One of the principal problems in composite piston casting techniques is achieving a strong, fracture resistant bond between the wear resistant ring and the aluminum or other lightweight alloy.

Yet another problem with casting composite pistons has been the number of machining steps and other labor processes required to finish the cast product.

The present invention contemplates a new and improved method and apparatus for casting composite articles, particularly pistons, which overcomes the above-referenced problems and others. Yet it provides a composite piston in which the unlike metal alloys are strongly bonded, which is crack and fatigue resistant, and which is finished with fewer machining steps.

SUMMARY OF THE INVENTION

In accordance with the present invention, there is provided a wear resistant insert for pistons cast of lightweight alloys. The insert comprises an annular ring of wear resistant material which has a generally cylindrical peripheral edge. The annular ring has at least one projection or tab which extends outward from the peripheral edge for positioning and supporting the annular ring in a die cavity during the casting of the piston.

In accordance with another aspect of the present invention, there is provided a method of casting in a die cavity a lightweight piston with a wear resistant insert. The wear resistant insert includes an annular ring having a peripheral edge and at least one frangible projection extending outward from the peripheral edge. The die cavity has an outer die surface, an opening, and means for supporting the annular ring by the projection in the die cavity. The method includes the steps of (1) disposing the annular ring in the die cavity with its frangible projection supported by the supporting means, (2) pouring a predetermined amount of molten lightweight alloy into the die cavity, (3) closing the die cavity opening with a punch which extends into the die cavity, and (4) applying a force with the punch on the lightweight alloy as it solidifies. The force being sufficient that as the lightweight alloy shrinks during solidification, the frangible projection breaks off freeing the annular ring to move with the shrinking.

A principal advantage of the present invention is that it produces a composite piston of a lightweight alloy with a wear resistant insert in which the bond between the lightweight alloy and the insert is strong and durable.

Another advantage of the present invention is that it minimizes machining steps, labor, and manufacturing time by casting a composite piston which is in close conformity to the shape of the final piston product.

BRIEF DESCRIPTION OF THE DRAWINGS

The invention may take physical form in certain parts and arrangements of parts, a preferred embodiment of which is illustrated in the accompanying drawings. The drawings are only for purposes of illustrating the preferred embodiments of the invention and are not to be construed as limiting it.

DESCRIPTION OF THE PREFERRED EMBODIMENTS

Figure 8:
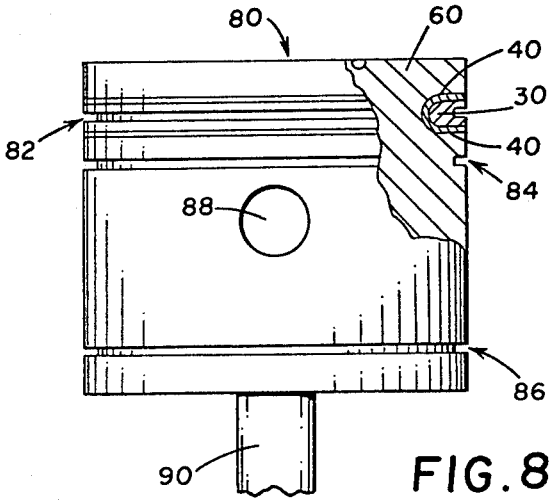
FIG. 8 is a perspective view in partial section of a composite piston manufactured in accordance with the present invention.

A mold assembly is illustrated in FIGS. 1–4 for casting composite pistons of a lightweight alloy with a wear resistant insert as illustrated in FIG. 8. The mold assembly includes a two-piece female die 10 which has a die cavity 12. The die cavity is shaped in conformity to the piston or other structure to be cast. The die cavity 12 includes an outer die surface 14 which is configured to conform to the exterior of the piston. The outer die surface 14 is smooth and polished to minimize machining steps to finish the cast piston. The outer die surface 14 extends peripherally around the die cavity along a circular path. In the center of the die cavity 12, a core 16 is disposed for defining a hollow interior to the piston. Toward the top of the die cavity is a supporting means 18 for supporting a wear resistant insert 20. In the preferred embodiment, the supporting means 18 is a peripheral ledge or land which extends around the outer die surface 14. Above the peripheral ledge or supporting means 18, the outer die surface 14 has an enlarged upper portion 22. This enables the insert 20 to be placed into the upper portion 22 of the die cavity 12 through an upper horizontal opening 24. The upper portion 22 has a cross section which conforms the periphery of the insert 20.

Figure 5:
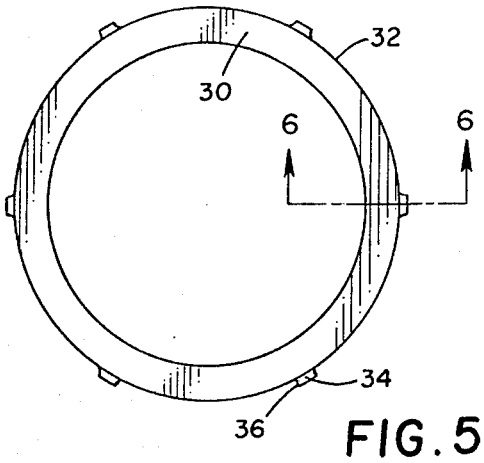
FIG. 5 is a top plan view of the wear resistant insert ring illustrated in FIGS. 1–4.
Figure 6:
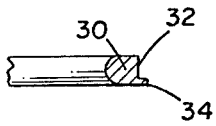
FIG. 6 is a cross-sectional view through section line 6—6 of FIG. 5.

The insert 20 comprises an annular ring 30 which is shown in greater detail in FIG. 5. The annular ring 30 is fashioned of a wear resistant material that has expansion and contraction properties which are similar to the expansion and contraction properties of the lightweight alloy from which the piston is to be cast. In the preferred embodiment, the wear resistant material is an austenitic alloy of iron, nickel, chromium, and copper, particularly advantageous is the alloy sold by Thomas Foundries, Inc. of Birmingham, Alabama under the trademark "NI-RESIST". The annular ring has a peripheral edge 32 which conforms with the exterior diameter of the piston to be cast. In the preferred embodiment, the diameter of the peripheral edge 32 is slightly larger than the finished piston to allow the exterior surface to be machined to close tolerances. Extending outward from the peripheral edge 32 is at least one projection. In the preferred embodiment, the at least one projection is a plurality of tabs 34 which are dimensioned to be received snugly within the upper portion 22 of the die cavity and rest on supporting means 18. The diameter of the peripheral edge 32 of the annular ring is dimensioned to be substantially the same or slightly smaller than the diameter of the outer die surface 14. As illustrated in FIG. 6, each of the tabs 34 is sufficiently thin that it is frangible under the pressures normally associated with squeeze casting. Alternatively, the at least one projection may be a continuous frangible flange which extends peripherally along the peripheral edge 32. As yet another alternative, the tabs 34 may be substantially the same thickness as the annular ring 30.

To cast a composite piston, the wear resistant annular ring 30 is cleaned, preheated, and coated with a thin coating 40 of ductile metal. The thickness of the coating 40 is exaggerated in FIGS. 1 and 8 for ease of illustration. The coating of ductile metal forms a stress absorbing buffer between the annular ring 30 and the lightweight alloy. In the preferred embodiment, the annular ring immersed in a bath of pure aluminum or aluminum alloy which is heated to within 200° F. of the temperature at which the lightweight alloy is to be cast. The duration which the annular ring 30 is immersed in the aluminum is kept to a minimum to minimize the formation of brittle aluminum-iron intermetallic compounds. After the annular ring 30 is preheated and coated with the ductile metal, it is placed on supporting means 18 in the die cavity.

A pouring disc 50 is placed in the upper opening of the cavity. The pouring disc 50 is a means for distributing the melted lightweight alloy into the die cavity during pouring. Particularly, it distributes the poured melted alloy such that it flows evenly over the insert 20. This inhibits the formation of oxides at the interface and assists in retaining the insert near the temperature of the molten alloy during the pouring operation.

Figure 1:
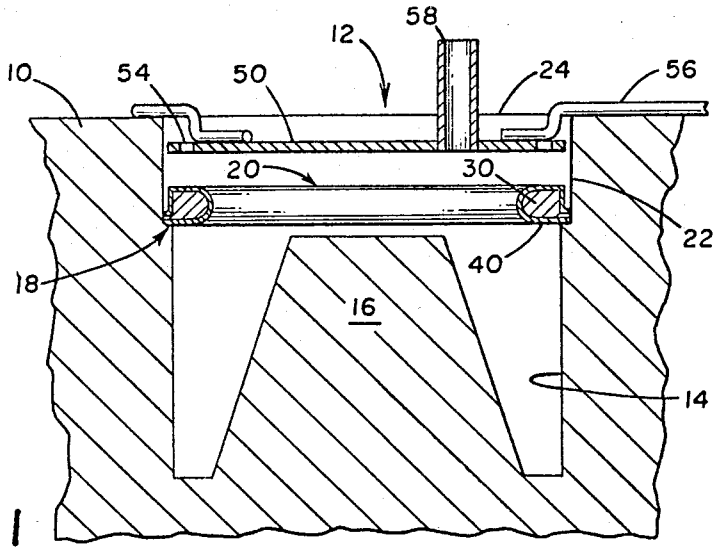
FIG. 1 is a cross-sectional view of a die cavity in which a wear resistant insert ring and a pouring disc are disposed in accordance with the present invention.
Figure 7:
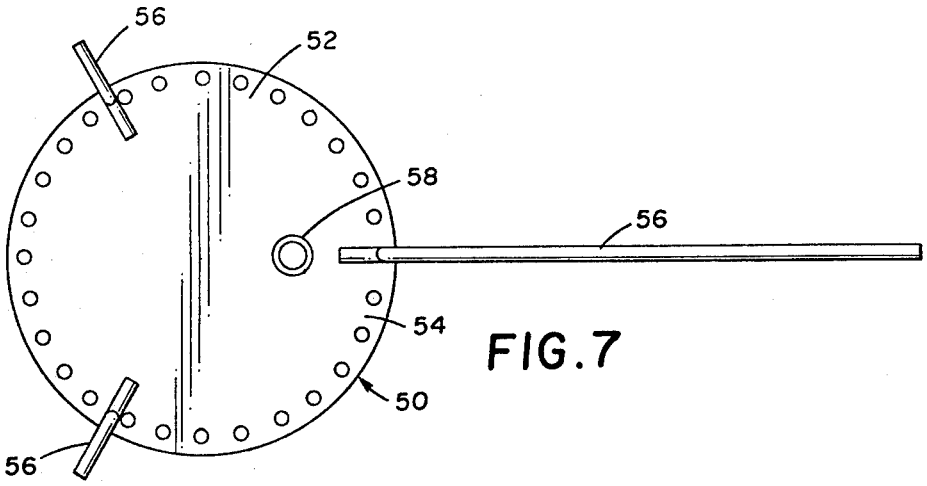
FIG. 7 is a top plan view of the pouring disc illustrated in FIGS. 1 and 2.

With continued reference to FIG. 1 and further reference to FIG. 7, the pouring disc 50 is dimensioned to be received in the upper portion 22 of the die cavity. The pouring disc has a central portion 52 which in conjunction with part of the upper portion 22 of the die cavity forms a temporary reservoir for receiving and holding the molten lightweight alloy. The depth of the temporary reservoir determines the pressure head of the molten alloy hence the flow rate into the die cavity.

Arranged peripherally around the pouring disc 50 are a plurality of passages for channeling the molten alloy into the mold cavity around its periphery. In the preferred embodiment, the plurality of passages is formed by a plurality of circular apertures 54 arranged around the perimeter of the pouring disc. Alternatively, the passages may include a plurality of radial slots around the periphery, a screen or mesh around the periphery, an annular gap between the disc and the die cavity, or the like.

Connected with the pouring disc 50 are a plurality of means 56 for supporting and centering its central portion 52 in the upper portion of the die cavity. Projecting upward from the central portion 52 of the pouring disc is a chimney 58 for allowing air within the die cavity to escape as molten lightweight alloy is poured in without aerating or agitating the molten alloy. The chimney 58 is a tubular projection of sufficient length to extend above the molten alloy in the temporary reservoir.

Figure 2:
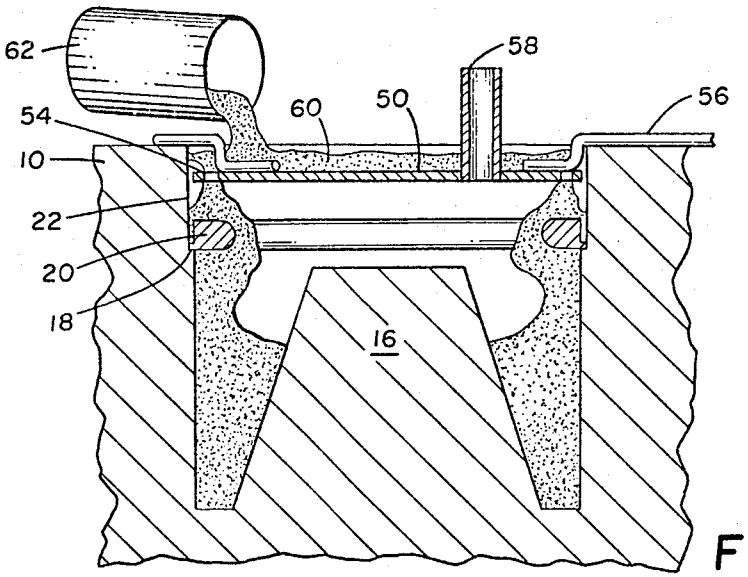
FIG. 2 is a cross-sectional illustration of the die cavity of FIG. 1 during the pouring of a molten lightweight alloy into the die cavity.

With particular reference to FIG. 2, before the preheated insert 20 cools, a predetermined amount of molten lightweight alloy, denoted by reference numeral 60, is poured from a furnace or crucible 62 onto the pouring disc 50. From the temporary reservoir, the molten alloy passes through the apertures 54 around the perimeter of the pouring disc and impinges upon the insert 20. The molten alloy flows over and around the insert into the lower portions of the die cavity. When the predetermined amount of molten alloy has been introduced into the die cavity, the pouring disc 50 is removed. The flow of the molten alloy partially dissolves the thin aluminum coating 40 making it even thinner.

Figure 3:
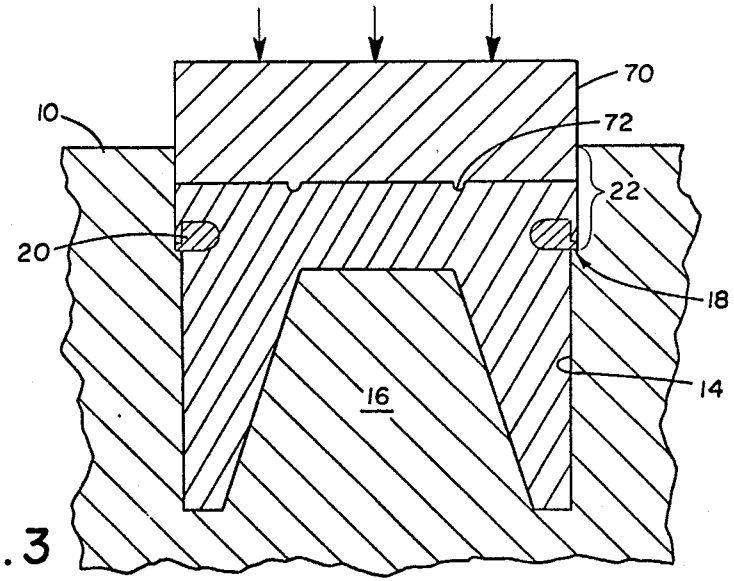
FIG. 3 is a cross-sectional illustration of the die cavity of FIGS. 1 and 2 after pouring in which an upper opening of the die cavity is closed by a top punch for exerting pressure on the solidifying alloy.

With particular reference to FIG. 3, the upper opening of the die cavity is closed by a top punch 70 with an annular projection 72 for forming a combustion bowl in the top of the piston. The top punch 70 is dimensioned to conform with the cross section of the upper portion 22 of the die cavity within very close tolerances to prohibit the molten alloy from passing between the punch and the outer die surface. Top punch 70 is caused by a hydraulic cylinder (not shown) to exert several tons of pressure on the lightweight alloy in the die cavity. As the molten alloy solidifies, it contracts. The top punch continues to press the alloy firmly and continuously against the surfaces of the die cavity, the punch, and the insert as the lightweight alloy solidifies. The contraction of the lightweight alloy during solidification allows the top punch 70 to advance into the die cavity by a corresponding amount. It has been found that the pressure from the top punch tends to deflect the annular ring which causes internal stresses after solidification. This deflection is alleviated with the annular ring construction of FIGS. 5 and 6 because the tabs 34 space the peripheral edge 32 of the ring a sufficient distance from the outer die surface 14 that the lightweight alloy flows between the ring and the die surface.

Figure 4:
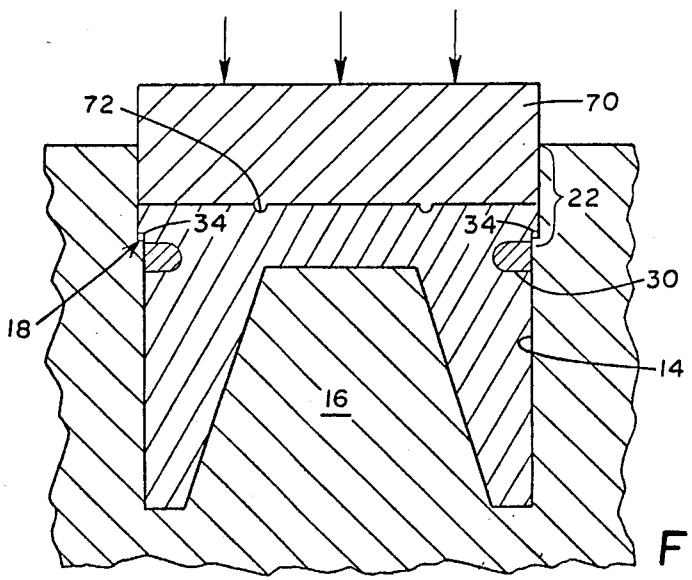
FIG. 4 is a cross-sectional illustration of the die cavity of FIGS. 1–3 after the lightweight alloy has solidified.

With particular reference to FIG. 4, the deflection is further reduced by the fracture of the frangible tabs 34. Under the pressure exerted by the top punch 70, the tabs 34 break allowing the annular ring 30 to shift downward in the die cavity with the contraction during solidification.

After the lightweight alloy solidifies, the top punch is withdrawn, the die cavity opened, and the composite piston removed. The composite piston is finished by a machining operation. Because the exterior surface conforms very closely to the surface of the punch and die, very little machining is required. The top surface of the piston conforms to the surface of the punch with sufficient accuracy that, as a rule, no further machining is required to finish the top surface. The exterior surface of the piston is machined to remove the severed tabs 34 and the excess material from the increased diameter of the upper portion 22 of the die cavity. The machining may further be used to give the piston a circular cross section within very precise dimensional tolerances. With reference to FIG. 8, the machining operation further includes cutting a plurality of grooves into the piston to receive piston rings. A top piston ring groove 82 is machined in the annular ring 30. Additional piston ring grooves 84 and 86 are also machined in the piston 80. A wrist pin 88 connects the piston 80 with a rod 90.

The invention has been described with reference to the preferred embodiment. Obviously, modifications and alterations will occur to others upon reading and understanding this specification. It is intended to include all such modifications and alterations insofar as they come within the scope of the appended claims or the equivalents thereof.

Having thus described preferred embodiments of my invention, I now claim as my invention:

1. A method of casting in a die cavity a lightweight piston with a wear resistant insert, the wear resistant insert including an annular ring having a peripheral edge and at least one frangible projection extending from the peripheral edge, the die cavity having an outer die surface, an opening, and means for supporting the annular ring in the die cavity, the method comprising:

disposing the annular ring in the die cavity with its frangible projection supported by the supporting means, pouring a predetermined amount of molten lightweight alloy into the die cavity;

closing the die cavity opening with a punch extending into the die cavity;

applying on the lightweight alloy a force with the punch which is sufficient to break the frangible projection, whereby as the lightweight alloy shrinks during solidification the projection breaks off allowing the annular ring to move.

2. The method as set forth in claim 1 wherein the at least one frangible projection includes a plurality of frangible tabs which are supported by the supporting means.

3. The method as set forth in claim 1 wherein the frangible projection is a peripheral flange.

* * * * *